US005812916A

United States Patent [19]

Kishimoto et al.

[11] Patent Number: 5,812,916

[45] Date of Patent: Sep. 22, 1998

[54] CONVEYER DEVICE AND TONER CARTRIDGE EQUIPPED WITH CONVEYER DEVICE

[75] Inventors: Teruki Kishimoto; Kazuo Johroku, both of Osaka, Japan

[73] Assignee: Mita Industrial Co., Ltd., Osaka, Japan

[21] Appl. No.: 880,361

[22] Filed: Jun. 23, 1997

[30] Foreign Application Priority Data

Jul. 4, 1996 [JP] Japan ..... 8-174550
Nov. 18, 1996 [JP] Japan ..... 8-306840

[51] Int. Cl.[6] ..... G03G 15/08

[52] U.S. Cl. ..... 399/263

[58] Field of Search ..... 399/258, 260, 399/262, 263; 222/DIG. 1; 366/133, 136

[56] References Cited

U.S. PATENT DOCUMENTS 5,264,900 11/1993 Momiyama et al. ..... 399/256
5,510,882 4/1996 Kikuta et al. ..... 399/257
5,579,094 11/1996 Behe et al. ..... 399/99
5,585,899 12/1996 Palumbo et al. ..... 399/258 X
5,657,115 8/1997 Sugihara ..... 399/263

*Primary Examiner*—S. Lee
*Attorney, Agent, or Firm*—Beveridge, DeGrandi, Weilacher & Young, LLP

[57] ABSTRACT

A conveyer device includes a container containing a toner therein and having a bottom wall and two side walls, a toner discharge port formed in the bottom wall, and a conveyance mechanism for conveying the toner in the container toward the discharge port. The conveyance mechanism includes a rotary shaft that is supported across both side walls to rotate and is positioned to pass above the discharge port, and a pair of spiral vanes formed on the rotary shaft. The vanes have their spiral directions opposite to each other. The discharge port has a first side edge and a second side edge opposed to each other at a distance in the axial direction of the rotary shaft. One of the spiral vanes extends from the first side edge toward the second side edge of the discharge port, above the toner discharge port. The other spiral vane extends from the second side edge toward the first side edge of the discharge port.

12 Claims, 6 Drawing Sheets

CONVEYER DEVICE AND TONER CARTRIDGE EQUIPPED WITH CONVEYER DEVICE

FIELD OF THE INVENTION

The present invention relates to a conveyer device for conveying a powder such as toner, and to a toner cartridge equipped with such a conveyer device.

DESCRIPTION OF THE PRIOR ART

In electrostatic copiers, electrostatic printers and electrostatic facsimiles, an electrostatic latent image is formed on an electrostatic photosensitive material and is then developed into a toner image. A developing device for developing the electrostatic latent image into the toner image comprises a developing housing that accommodates a so-called one-component developing agent consisting of the toner only or a so-called two-component developing agent consisting of the toner and the carrier particles; a developing agent application means for conveying the developing agent accommodated in the developing housing to a developing zone to apply it to the electrostatic photosensitive material; and a toner replenishing means for replenishing the developing housing with the toner. The toner replenishing means usually includes a toner cartridge which is detachably attached. A typical toner cartridge includes a container which contains the toner and has a bottom wall and both side walls, a toner discharge port formed in the bottom wall, and a conveyance mechanism for conveying the toner present in the container toward the discharge port. The discharge port is formed at a position closer to one side wall between the two side walls.

The conveyance mechanism in the conveyer device includes a rotary shaft that is rotatably supported across both side walls and is positioned to pass above the discharge port, a pair of spiral vanes formed on the rotary shaft and having spiral directions opposite to each other, and a plurality of discharge vanes. The discharge vanes are formed of plate pieces that are disposed at equal angular intervals to each other and protrude in the radial direction from the rotary shaft, and are positioned above the discharge port. Of the pair of spiral vanes, one spiral vane extends between the other side wall of the container and the discharge vanes, and the other spiral vane extends between one side wall of the container and the discharge vanes. Since the discharge port is formed at a position closer to one side wall between the two side walls, one spiral vane has an overall length which is larger than that of the other spiral vane. The spiral vanes have substantially the same outer diameter and pitch.

An end of the rotary shaft of the conveyance mechanism protrudes toward the outside of the container beyond the side wall of the container, and an input gear is fitted to the protruded end. When a toner cartridge is mounted on a required position of the developing device, the input gear fitted to the rotary shaft of the moving mechanism is drivably coupled to an electric motor via a transmission gear train, whereby the rotary shaft, spiral vanes and discharge vanes in the conveyance mechanism are driven by the electric motor. The toner present in the container is conveyed from both sides of the container toward the discharge vanes by the rotation of the spiral vanes, and the toner conveyed by the discharge vanes is permitted to directly fall (discharged) into the developing housing positioned under the toner cartridge through the discharge port that is opened, or is permitted to fall into the toner hopper positioned under the toner cartridge through the discharge port. The toner that has fallen into the toner hopper is conveyed into the developing housing through another conveyance mechanism disposed in the toner hopper. Thus, the toner is supplied from the toner cartridge to the developing device.

However, the above-mentioned conventional toner cartridge has problems that must be solved as described below.

(1) As described above, above the toner discharge port are disposed the rotary shaft and the four discharge vanes that protrude in the radial direction from the rotary shaft. These discharge vanes are so arranged as to limit the amount of the toner (amount of discharge) falling through the toner discharge port, so that the toner falls (is discharged) in a suitable amount in compliance with the rotation of the conveyance mechanism. In practice, however, the toner falls in a relatively small amount immediately after the start of rotation of the conveyance mechanism, and a relatively long period of time is required until the toner falls in a stabilized amount. Immediately after the start of rotation of the conveyance mechanism, therefore, the toner is momentarily supplied in small amounts to the developing device; i.e., the toner is liable to be not stably supplied in a predetermined amount at all times from the toner cartridge to the developing device.

In order to solve the above-mentioned problem, it can be contrived to leave out the discharge vanes positioned above the toner discharge port. With this constitution, however, the rotary shaft only exists as the conveyance mechanism above the toner discharge port. Contrary to the above-mentioned case, therefore, the toner falls in a relatively large amount immediately after the start of rotation of the conveyance mechanism. When the toner hopper having another conveyance mechanism is disposed under the toner discharge port, therefore, the toner tends to be blocked under the toner discharge port. Immediately after the start of rotation of the conveyance mechanism, therefore, the toner is momentarily supplied in excess amounts to the developing device; i.e., the toner is not stably supplied in a predetermined amount at all times from the toner cartridge to the developing device.

(2) As described above, furthermore, one spiral vane has a length which is greater than that of the other spiral vane, and these two spiral vanes have substantially the same outer diameter and pitch. Since one of the spiral vanes has a larger overall length than the other and the two spiral vanes have substantially the same pitch, the pressure of the toner in the container that is conveyed by one spiral vane toward the discharge port continuously increases proportionally from an end remotest from the discharge port toward the discharge port (see two-dotted chain line in FIG. 8).

Therefore, the larger the amount of the toner in the container is, the larger the amount of the toner that is conveyed becomes. This causes the pressure to rise in the upper part of the discharge port which is near the outlet of one spiral vane. Accordingly, the amount of the toner that is conveyed becomes larger than the amount of the toner falling from the discharge port, the toner present on the upper portion of the discharge port falls after some delay, and the pressure further increases. In consequence, the toner will cause clogging (blocking) at the upper part of the discharge port in a relatively early time. When the discharge port is clogged with the toner, the spiral vanes no longer rotate, and the conveyance of the toner is halted.

The velocity for conveying the toner by one spiral vane remains constant throughout the overall length of the one spiral vane, whereas the pressure of the toner conveyed by one spiral vane gradually increases from a portion remotest from the discharge port toward the discharge port. Due to this fact, the toner contained in the container is discharged while decreasing from the portion remotest from the discharge port. In other words, the toner in the container starts emptying gradually from the portion remotest from the discharge port. Thus, the toner contained in the container is not uniformly discharged (decreased) over the full length of the rotary shaft in the axial direction thereof. Therefore, the toner located closer to the discharge port falls less onto the spiral vane located on the lower side thereof and hence, stays longer at the same position in the container. Accordingly, the toner tends to be solidified due to its own weight. As a result, part of the toner located relatively close to the discharge port coagulates, and does not fall on one spiral vane and is not discharged but remains like a tunnel (occurrence of tunnelling phenomenon). Consequently, the toner is wasted in large amounts.

That is, in the above-mentioned conventional toner cartridge, the toner present at the upper part of the discharge port falls after some delay, the discharge port is clogged with the toner, the toner in the container is partly coagulated, is not conveyed by one spiral vane but remains in the form of a tunnel in the container. The above-mentioned problem is not only specific to the toner cartridge but also takes place even in a developing device equipped with a toner conveying device and in a device of a different type equipped with a conveyer device for conveying powder other than the toner.

SUMMARY OF THE INVENTION

A first object of the present invention is to provide a novel and improved conveyer device capable of stably feeding a powder such as toner in a predetermined amount at all times.

A second object of the present invention is to provide a novel and improved toner cartridge capable of stably feeding the toner in a predetermined amount at all times.

A third object of the present invention is to provide a novel and improved conveyer device capable of smoothly and reliably conveying a powder such as toner without allowing it to cause clogging and without permitting it to remain in the container.

A fourth object of the present invention is to provide a novel and improved toner cartridge capable of smoothly and reliably conveying the toner without permitting it to cause clogging and without permitting it to remain in the container.

In order to accomplish the above-mentioned first object according to a first aspect of the present invention, there is provided a conveyer device comprising a container containing a powder therein and having a bottom wall and both side walls, a powder discharge port formed in said bottom wall, and a conveyance mechanism for conveying the powder contained in said container toward said discharge port, said conveyance mechanism including a rotary shaft that is rotatably supported across said both side walls and is positioned to pass above said discharge port and a pair of spiral vanes formed on said rotary shaft and having the spiral directions opposite to each other, and said discharge port having one (a first) side edge and an other (second) side edge opposed to each other at a distance in the axial direction of said rotary shaft, wherein one of said spiral vanes extends from said one side edge toward said other side edge of said discharge port above said discharge port, and the other one of said spiral vanes extends from said other side edge toward said one side edge.

In order to accomplish the above-mentioned second object according to a second aspect of the present invention, there is provided a toner cartridge including a conveyer device which comprises a container containing a toner therein and having a bottom wall and both side walls, a toner discharge port formed in said bottom wall, and a conveyance mechanism for conveying the toner contained in said container toward said toner discharge port, said conveyance mechanism including a rotary shaft that is rotatably supported across said both side walls and is positioned to pass above said toner discharge port and a pair of spiral vanes formed on said rotary shaft and having the spiral directions opposite to each other, and said toner discharge port having one (a first) side edge and the other (second) side edge opposed to each other at a distance in the axial direction of said rotary shaft, wherein one of said spiral vanes extends from said one side edge toward said other side edge of said discharge port above said toner discharge port, and the other one of said spiral vanes extends from said other side edge toward said one side edge.

According to the above-mentioned present invention, one spiral vane extends from one side edge toward the other side edge of the discharge port for discharging powder such as toner at the upper part of the discharge port, and the other spiral vane extends from the other side edge toward one side edge. That is, above the discharge port are present the one spiral vane and the other spiral vane in addition to the rotary shaft. Immediately after the start of rotation of the conveyance mechanism, therefore, the falling amount of the powder does not become too small unlike that of when the rotary shaft and the discharge vanes are present above the discharge port, or does not become too large unlike that of when the rotary shaft only is present above the discharge port. Accordingly, the powder is permitted to fall in a proper amount from just after the start of rotation of the conveyance mechanism, and the powder is stably supplied in a predetermined amount at all times.

It is desired that the two spiral vanes extend up to one-third the distance between the one side edge and the other side edge. An embodiment also holds true in which the two spiral vanes extend by more than one-third or one-half the distance between the one side edge and the other side edge.

It is desired that the spiral vanes have substantially the same outer diameter D and pitch P, and the discharge port is provided with one end edge and the other end edge opposed to each other at a distance W in a direction at right angles with the axial direction, and when the distance between said one side edge and said other edge is denoted by L, the following relations are satisfied, $W=0.95\ D$ to $1.05\ D$ $L=0.95\ P$ to $1.05\ P$.

In order to accomplish the above-mentioned third object according to a third aspect of the present invention, there is provided a conveyer device comprising a container containing a powder therein and having a bottom wall and both side walls, a powder discharge port formed in said bottom wall, and a conveyance mechanism for conveying the powder contained in said container toward said discharge port, said conveyance mechanism including a rotary shaft that is rotatably supported across said both side walls and is positioned to pass above said discharge port and spiral vane means formed on said rotary shaft, wherein said spiral vane means includes a spiral vane which is so formed that the pitch thereof stepwisely decreases in a plurality of ranges in the axial direction as it separate away from said discharge port in the axial direction.

According to the above-mentioned invention, the pressure of the powder conveyed by the rotating spiral vane toward the discharge port stepwisely increases as it approaches the discharge port over the ranges of dissimilar pitches. That is, in the ranges of dissimilar pitches, the pressure has a tendency to increase from an end remotest from the discharge port toward a direction in which it approaches the discharge port. Here, the pitch increases at a boundary between a range remote from the discharge port and a neighboring range which is closer to the discharge port. Therefore, the pressure once suddenly decreases at the boundary where the pitch changes. In other words, the pressure of the powder being conveyed does not continuously increase as it approaches the discharge port from the end remotest from the discharge port, which was the case of the prior art. Instead, the pressure stepwisely increases in a manner of increase, decrease, increase, decrease.

Since the pressure for conveying the toner necessarily decreases at a boundary where the pitch changes, the pressure of the powder can be decreased compared to that of the prior art above the discharge port which is the powder outlet of the spiral vanes without causing the amount of the toner conveyed by the spiral vanes to decrease. Accordingly, the amount of conveying the powder is relatively uniformalized irrespective of the amount of the powder contained in the container, and the amount of the powder that is conveyed is brought into proper match with the amount of the powder falling through the discharge port. As a result, the powder staying above the discharge port falls in an early time; i.e., the powder present above the discharge port in the container is discharged first, reliably preventing formation of clogging by the powder at the upper part of the discharge port.

According to the present invention, furthermore, the velocity for conveying the powder by the spiral vane is not constant over the full length of the spiral vane but stepwisely increases as it approaches the discharge port in the ranges in which the spiral vane has dissimilar pitches. That is, the pitch changes to a direction of increasing at a boundary between a range remote from the discharge port and a neighboring range closer to the discharge port. Therefore, the velocity for conveying the powder increases at the boundary where the pitch changes. That is, a difference in the velocity for conveying the powder is produced at the boundary between a range remote from the discharge port and a neighboring range closer to the discharge port. At the boundary, therefore, a difference is produced in the amount of conveyance (the amount of conveyance by the spiral vane is larger in a range closer to the discharge port than the amount of conveyance by the spiral vane remote from the discharge port).

As a result, the powder present above the boundary falls on the spiral vane before the power is conveyed by the spiral vane from the downstream side and hence, the powder in the container is uniformly discharged as a whole. This makes it possible to reliably prevent such an inconvenience that the powder in the container is partly coagulated (tunneling phenomenon). Accordingly, the powder does not remain in the container but is all discharged without waste. According to the present invention as will be obvious from the foregoing description, the powder such as toner is smoothly and reliably conveyed without allowing it to cause clogging and without permitting it to remain in the container.

In order to accomplish the above-mentioned fourth object according to a fourth aspect of the present invention, there is provided a toner cartridge including a conveyer device which comprises a container containing a toner therein and having a bottom wall and both side walls, a toner discharge port formed in said bottom wall, and a conveyance mechanism for conveying the toner contained in said container toward said toner discharge port, said conveyance mechanism including a rotary shaft that is rotatably supported across said both side walls and is positioned to pass above said toner discharge port and spiral vane means formed on said rotary shaft, wherein said spiral vane means is so formed that the pitch thereof stepwisely decreases in a plurality of ranges in the axial direction as it separates away from said discharge port in the axial direction.

According to the present invention, the pressure of the toner can be decreased compared to that of the prior art above the discharge port which is the toner outlet of the spiral vane without causing the amount of the toner conveyed by the spiral vane to decrease. Accordingly, the amount of conveying the toner is relatively uniformalized irrespective of the amount of the toner contained in the container, and the amount of the toner that is conveyed is brought into proper match with the amount of the toner falling through the discharge port. As a result, the toner staying at the upper part of the discharge port falls in an early time; i.e., the toner present above the discharge port in the container is discharged first, reliably preventing formation of clogging by the toner above the discharge port.

Furthermore, a difference in the velocity for conveying the toner is produced at the boundary (where the pitch changes) between a range remote from the discharge port and a neighboring range closer to the discharge port. Therefore, a difference is produced in the amount of conveyance (the amount of conveyance by the spiral vane is larger in a range closer to the discharge port than the amount of conveyance by the spiral vane remote from the discharge port). As a result, the toner present above the boundary falls on the spiral vane before the toner is conveyed by the spiral vane from the downstream side and hence, the toner in the container is uniformly discharged as a whole. This makes it possible to reliably prevent such an inconvenience that the toner in the container is partly coagulated (tunneling phenomenon). Accordingly, the toner does not remain in the container but is all discharged without waste.

It is desired that the discharge port is formed at a position closer to either one of the two side walls, the spiral vane means comprises a pair of spiral vanes having spiral directions that are opposite to each other at the portion of the discharge port as a boundary, either one of the two spiral vanes has an overall length larger than the overall length of the other spiral vane, and one spiral vane has such a pitch which stepwisely decreases in a plurality of ranges in the axial direction as it separates away from the discharge port in the axial direction.

According to the present invention, the spiral vane having the larger overall length is constituted as described above, making it possible to smoothly and reliably convey the toner or the powder such as toner without permitting it to cause clogging or without permitting it to remain in the container.

In addition to the above-mentioned constitution, it is desired that the other spiral vane has a pitch which is not larger than a minimum pitch of said one spiral vane.

According to the present invention, the amount of conveying the toner or the powder such as toner by the spiral vane having smaller overall length is minimized, making it possible to maintain a suitable balance with the amount of conveyance by the spiral vane having the larger overall length. Therefore, the toner in the container is uniformly discharged as a whole.

BRIEF DESCRIPTION OF THE DRAWINGS

FIG. 5 is viewed from the left side; and

DETAILED DESCRIPTION OF THE PREFERRED EMBODIMENTS

Figure 1:
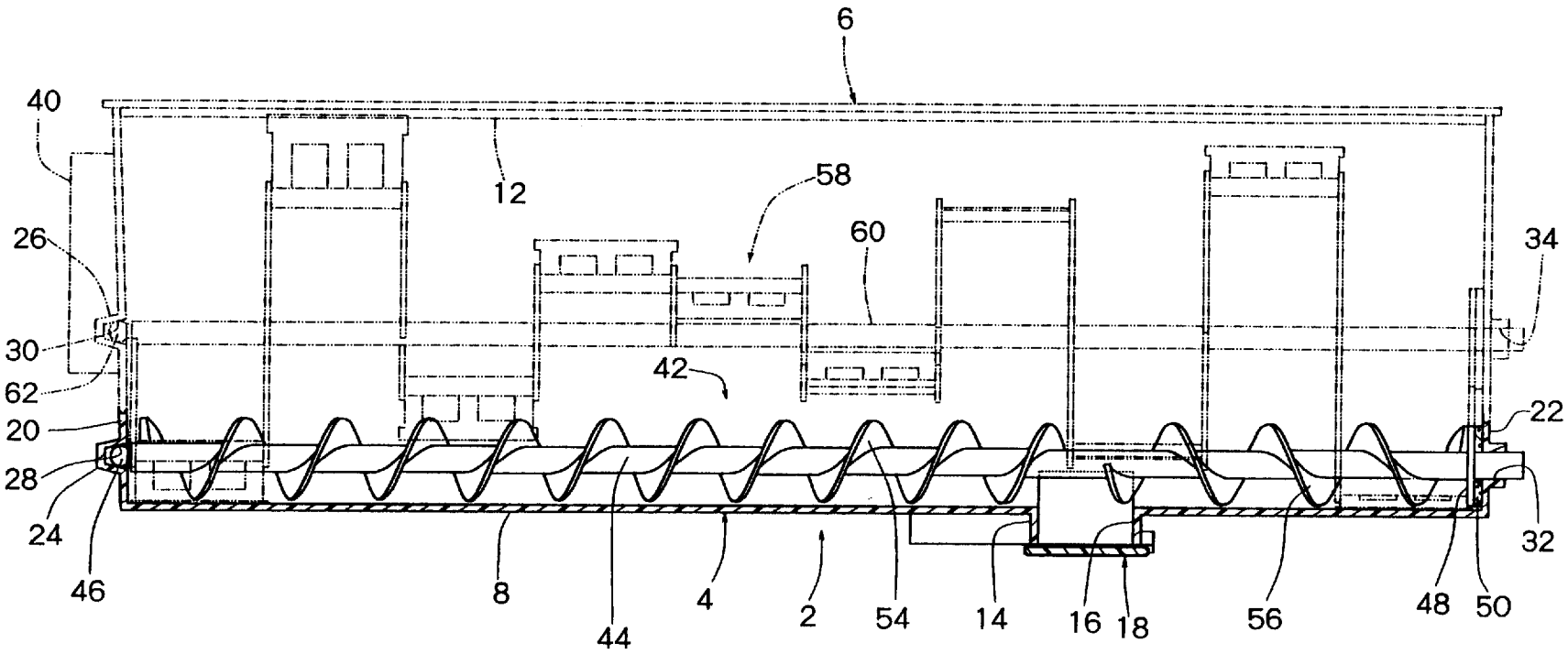
FIG. 1 is a sectional view illustrating, in the axial direction, a toner cartridge constituted according to a preferred embodiment of the present invention which is held in a container, but omitting the toner in the container.

Preferred embodiments of the toner cartridge constituted according to the present invention will now be described in further detail with reference to the accompanying drawings.

The toner cartridge constituted according to a first embodiment of the present invention will be described, first, with reference to FIGS. 1 to 4. The illustrated toner cartridge has a container that is generally designated at 2. The container 2 is constituted by a main member 4 and a closure member 6. The main member 4 which can be made of a suitable synthetic resin has the shape of a box with its upper surface opened. As will be clearly comprehended with reference to FIG. 3, the bottom wall of the main member 4 comprises two portions 8 and 10 arranged in parallel in the transverse sectional view. The portion 8 is defined by a relatively small arcuate portion. The portion 10 is defined by a linear central portion that extends substantially horizontally and by arcuate portions positioned on both sides thereof. The closure member 6 which can similarly be made of a suitable synthetic resin has the shape of a flat plate and has on the lower surface thereof a protrusion 12 of a shape corresponding to a rectangular opening formed in the upper surface of the main member 4. The closure member 6 is positioned on the upper surface of the main member 4 with its protrusion 12 protruding inwardly of the main member 4, and is secured to the main member 4 by a suitable method such as ultrasonic welding to close the upper surface of the main member 4.

Figure 4:
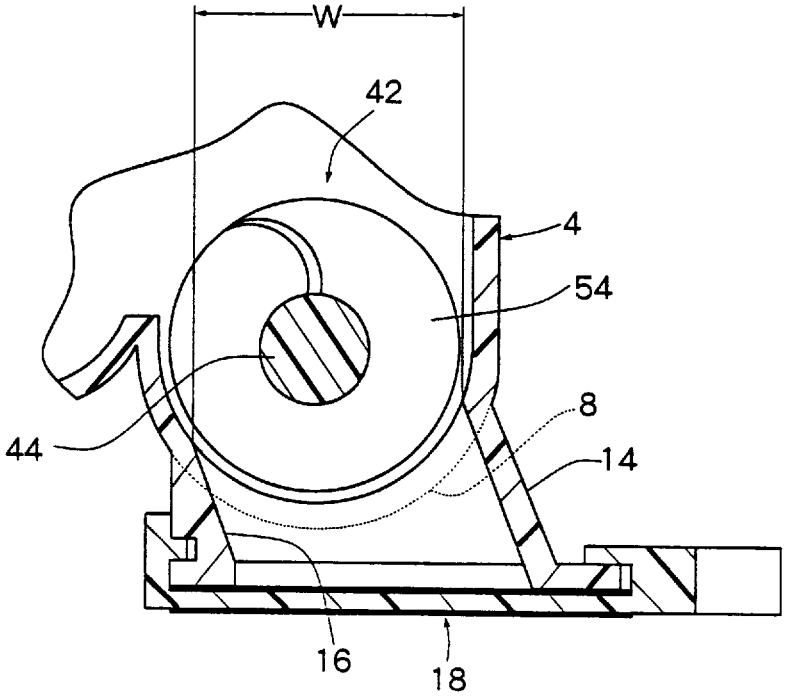
FIG. 4 is an enlarged view near a toner discharge port of FIG. 3.

In the arcuate portion 8 of the bottom wall is formed a downwardly protruding mouth portion 14 of nearly a rectangular shape in which is formed a toner discharge port 16. The toner discharge port 16 has nearly a rectangular shape, and is provided with one side edge and the other side edge, which are opposed to each other at a distance L in the axial direction of a rotary shaft 44 of a conveyer device 42 that will be described later, and with one end edge and the other end edge, which are opposed to each other at a distance W in a direction at right angles with the axial direction. As shown in FIG. 4, the toner discharge port 16 has its upper end opened in the upper surface of the arcuate portion 8 and has its lower end opened in the horizontal lower surface of the mouth portion 14. The mouth portion 14 is equipped with a shutter member 18 which slides between a close position to close the toner discharge port 16 and an open position to open the toner discharge port 16. The shutter member 18 may be constituted in a known form and its details are not described in this specification.

Figure 2:
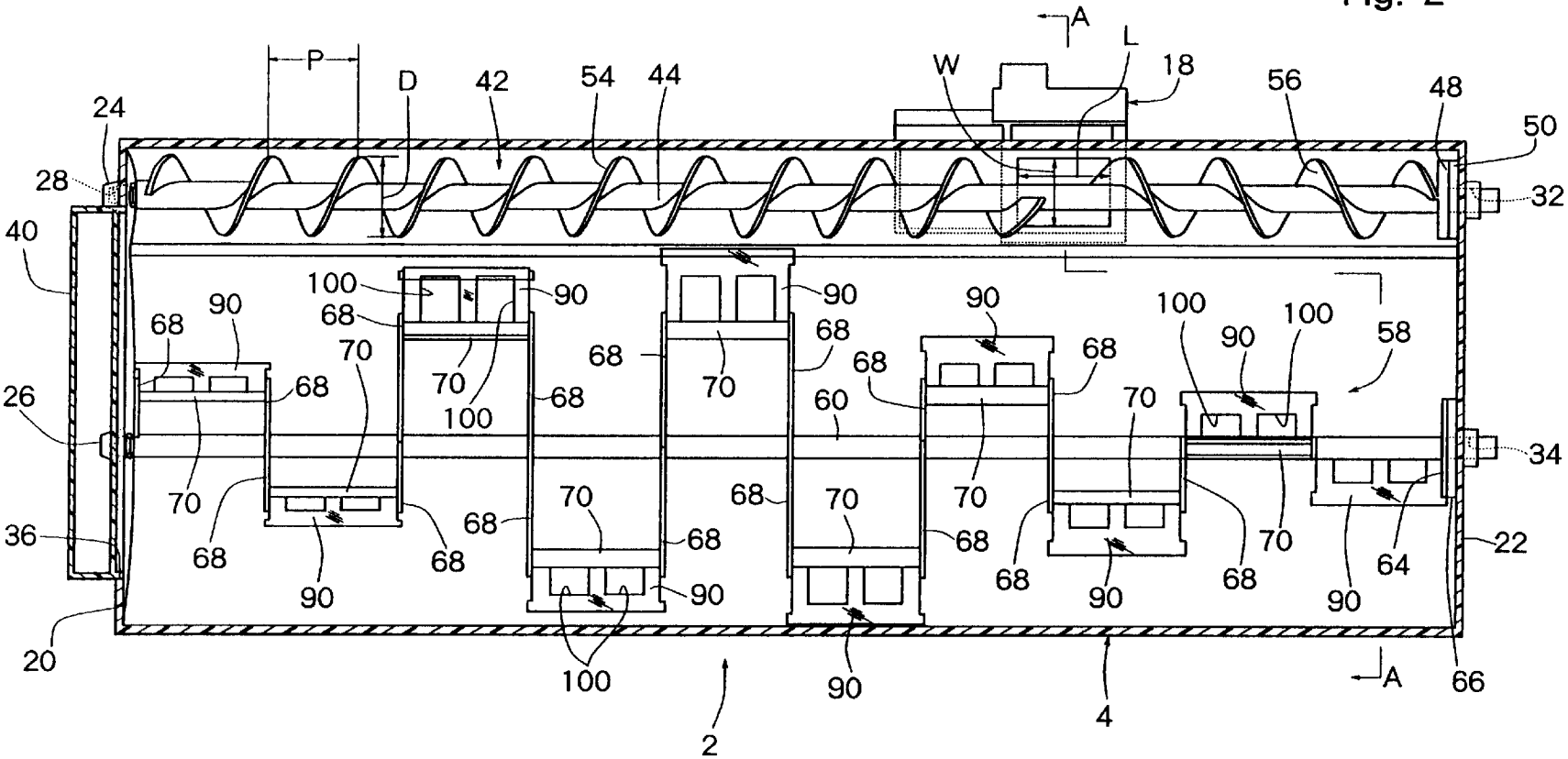
FIG. 2 is a plan view illustrating the toner cartridge shown in FIG. 1, omitting the upper closure of the container and the toner in the container.
Figure 3:
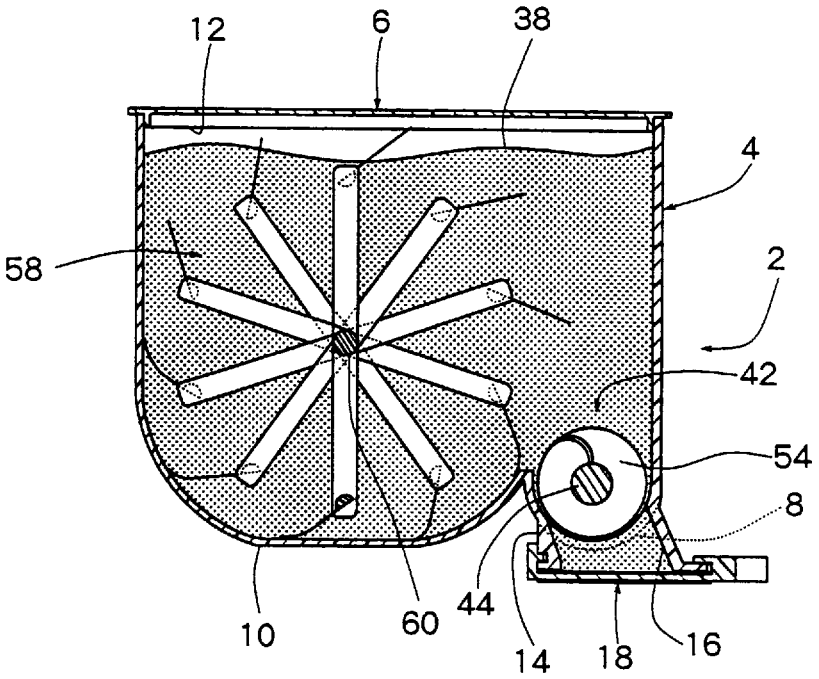
FIG. 3 is a transverse sectional view along the line A—A of FIG. 2.

The main member 4 of the container 2 has both side walls 20 and 22. Two protruding portions 24 and 26 are formed on one side wall 20, and blind holes 28 and 30 are defined on the inside of the protruding portions 24 and 26. The blind holes 28 and 30 have the shape of a circular truncated cone with their inner diameter gradually increasing inwardly. In the other side wall 22 are formed through holes 32 and 34 that correspond respectively to the blind holes 28 and 30. The blind hole 28 and the through hole 32 are positioned on the center line of curvature of the arcuate portion 8 on the bottom wall. The other blind hole 30 and the other through hole 34 are positioned on an axis that passes nearly through the center of upper space of the portion 10 of one side of the bottom wall. In the side wall 20 is further formed a relatively large circular opening 36 (FIG. 2). Through the opening 36, the container 2 is filled with a toner 38 in a required amount (FIG. 3). After the container is filled with the toner 38, a closing member 40 is fitted to the side wall 20 by welding or bonding thereby to close the opening 36.

With further reference to FIGS. 1 to 3, the container 2 contains a toner conveyer device 42 arranged above the arcuate portion 8 of the bottom wall. The conveyer device 42 includes a toner conveyance mechanism which is provided with a rotary shaft 44. As shown in FIG. 1, one end 46 of the rotary shaft 44 is of a nearly spherical shape having a diameter which lies between a minimum inner diameter and a maximum inner diameter of the blind hole 28. Near the other end of the rotary shaft 44 is formed a circular flange 48. Furthermore, an annular sealing member 50 is fitted to the rotary shaft 44 on the outer side of the circular flange 48. The sealing member 50 may be made of a soft sponge. The rotary shaft 44 is inserted, at its nearly spherically shaped one end 46, in the blind hole 28 formed in the side wall 20 of the container 2 as shown in FIG. 1. The whole rotary shaft 44 is elastically deformed to some extent and is passed, at its other end, through the hole 32 formed in the side wall 22 of the container 2, so as to be mounted across the side walls 20 and 22 to rotate. In this state, the rotary shaft 44 is positioned to pass above the toner discharge port 16.

As will be easily comprehended with reference to FIG. 1, the blind hole 28 has the shape of a circular truncated cone, and the one end 46 of the rotary shaft 44 is nearly of a spherical shape. Therefore, the outer peripheral surface of the one end 46 of the rotary shaft 44 is brought into line contact, instead of surface contact, with the inner peripheral surface of the blind hole 28 irrespective of some machining error and hence, excess rotational resistance is never created by the frictional contact between the blind hole 28 and the one end 46 of the rotary shaft 44. When the other end of the rotary shaft 44 is passed through the hole 32, the circular flange 48 is positioned close to the inner surface of the side wall 22, and the sealing member 50 is compressed to some extent between the circular flange 48 and the side wall 22. Thus, the sealing member 50 prevents the toner 38 from leaking out of the container through the hole 32.

The other end of the rotary shaft 44 protrudes outwardly penetrating through the side wall 22, and an input gear (not shown) is fitted to the protruded end. When the toner cartridge is mounted on a required position of a developing device (not shown), the input gear is coupled to an electric motor (not shown) via a transmission gear train (not shown). When the electric motor is energized, the rotary shaft 44 is rotated in the counterclockwise direction in FIG. 3. As will be comprehended with reference to FIGS. 1 and 2, the conveyance mechanism further has a pair of spiral vanes 54 and 56 formed on the rotary shaft 44. The spiral direction of the spiral vane 54 is opposite to the spiral direction of the spiral vane 56. The spiral vane 54 extends from the side wall 20 to the toner discharge port 16 and further extends from one side edge to the other side edge of the toner discharge port 16. The spiral vane 56 extends from the side wall 22 to the toner discharge port 16 and further extends from the other side edge to the one side edge of the toner discharge port 16. The spiral vane 54 extends by a length ⅓ L from one side edge of the toner discharge port 16, and the spiral vane 56 extends by a length ⅓ L from the other side edge of the toner discharge port 16. Above the toner discharge port 16, therefore, neither the spiral vane 54 nor the spiral vane 56 exists but the rotary shaft 44 only exists above a length ⅓ L located midway between the one side edge and the other side edge.

The spiral vanes 54 and 56 have substantially the same outer diameter D and the pitch P. There is the following relationship between the distance W from the one end edge to the other end edge of the toner discharge port 16 and the outer diameter D of the spiral vanes 54 and 56, i.e., W=0.96 D. It is desired that the distance W is defined to lie within a range of W=0.95 D to 1.05 D.

Further there is the following relationship between the distance L from the one side edge to the other side edge of the toner discharge port 16 and the pitch P of the spiral vanes 54 and 56, i.e., L=P. It is desired that the distance L is defined to lie within a range of L=0.95 P to 1.05 P.

When the rotary shaft 44 rotates in the counterclockwise direction in FIG. 3, the spiral vane 54 conveys the toner 38 rightwardly toward the toner discharge port 16 in FIGS. 1 and 2, and the spiral vane 56 conveys the toner 38 leftwardly toward the toner discharge port 16 in FIGS. 1 and 2. The toner 38 conveyed to a portion above the toner discharge port 16 is allowed to fall down from the container 2 through the toner discharge port 16. Thus, the toner 38 is supplied from the toner cartridge to the developing device (not shown).

In the above-mentioned embodiment, above the toner discharge port 16, the spiral vane 54 extends by a length ⅓ L from the one side edge toward the other side edge of the toner discharge port 16 and the spiral vane 56 extends by a length ⅓ L from the other side edge toward the one side edge. Owing to this constitution, the amount of the toner 38 falling immediately after the start of rotation of the transfer mechanism does not become too small unlike that of the prior art in which the rotary shaft and the discharge vanes are present above the toner discharge port 16, and does not become too large, either, unlike that of the prior art in which the rotary shaft only is present above the toner discharge port 16. Accordingly, the toner 38 is allowed to fall in a proper amount immediately after the start of rotation of the conveyance mechanism and is stably supplied in a predetermined amount at all times. In other words, the time is very shortened until the falling amount of the toner 38 stabilizes, making it possible to reliably avoid such an occurrence that the toner temporarily becomes insufficient in the developing device. The embodiment also holds true in which the spiral vanes 54 and 56 extend by more than ⅓ L or by more than ½ L from the one side edge and the other side edge of the toner discharge port 16. Even this constitution makes it possible to achieve effects superior to those of the above-mentioned conventional conveyer device.

Setting the relationship between the distance W of the toner discharge port 16 and the outer diameter D of the spiral vanes 54 and 56 to be W=0.96 D and setting the relationship between the distance L of the toner discharge port 16 and the pitch P of the spiral vanes 54 and 56 to be L=P contribute to achieving the above-mentioned effects. Desired ranges for accomplishing the above-mentioned effects are W=0.95 D to 1.05 D and L=0.95 P to 1.05 P.

It is desired that the rotary shaft 44, flange 48 and spiral vanes 54 and 56 of the toner conveyer device 42 are molded as a unitary structure using a suitable synthetic resin. Thus, the resilient deformation is relatively easily made in the assembling operation in which one end of the rotary shaft 44 is inserted in the blind hole 28 and the other end thereof is inserted in the through hole 32, contributing to facilitating the assembling operation.

The container 2 further contains a stirrer 58 located on the portion 10 of the other side of the bottom wall. With reference to FIGS. 1 to 3, the stirrer 58 includes a rotary shaft 60. One end 62, too, of the rotary shaft 60 is formed in a nearly spherical shape like the one end of the rotary shaft 44 of the conveyer device 42, and has a diameter which lies between a minimum inner diameter and a maximum inner diameter of the blind hole 30. A circular flange 64 is formed near the other end of the rotary shaft 60, and an annular sealing member 66 is fitted to the rotary shaft 60 on the outer side of the circular flange 64. The sealing member 66 may be made of a soft sponge or a synthetic rubber. The rotary shaft 60 is inserted, at its nearly spherically shaped one end 62, in the blind hole 30 formed in the side wall 20 of the container 2 like the rotary shaft 44 of the conveyer device 42 and is inserted, at its other end, through the hole 34 formed in the side wall 22 of the container 2 by elastically deforming the entire rotary shaft to some extent so that it is rotatably mounted between the side walls 20 and 22.

Like that of the relationship between the one end 46 of the rotary shaft 44 and the blind hole 28 shown in FIG. 1, the blind hole 30 has the shape of a circular truncated cone and the end 62 of the rotary shaft 60 is nearly of a spherical shape. Therefore, the outer peripheral surface of the one end 62 of the rotary shaft 60 is brought into line contact, instead of surface contact, with the inner peripheral surface of the blind hole 30 irrespective of some machining error and hence, excess rotational resistance is never created by the frictional contact between the blind hole 30 and the one end 62 of the rotary shaft 60. When the other end of the rotary shaft 60 is passed through the hole 34, the circular flange 64 is positioned close to the inner surface of the side wall 22, and the sealing member 66 is compressed to some extent between the circular flange 64 and the side wall 22. Thus, the sealing member 66 prevents the toner 38 from leaking out of the container through the hole 34. The other end of the rotary shaft 60 protrudes outwardly penetrating through the side wall 22, and an input gear (not shown) is fitted to the protruded end. The input gear engages with a gear (not shown) fitted to the protruded end of the rotary shaft 44 of the conveyer device 42. When the electric motor is energized to rotate the rotary shaft 44 of the conveyer device 42 in the counterclockwise direction in FIG. 3, the rotary shaft 60 of the stirrer 58 rotates in the counterclockwise direction in FIG. 3.

On the rotary shaft 60 of the stirrer 50 are arranged twenty arms 68 at equal intervals in the axial direction. The arms 68 extend in the radial direction from the outer peripheral surface of the rotary shaft 60, but one of arms 68 extends in the radial direction from the outer peripheral edge of a circular flange 64 formed on the rotary shaft 60. The arms 68 are located at the same angular position, and a paddle 70 is disposed between the ends of the pairs of arms that are neighboring each other in the axial direction. The pairs of arms 68 as a whole are disposed in a dispersed manner at predetermined angular positions at intervals in the circumferential direction of the rotary shaft 60. Accordingly, the paddles 70 are not disposed at the same angular position but are disposed at ten different angular positions each at an angular interval of 36 degrees.

The distance is substantially the same from the center axis of the rotary shaft 60 to the ends of the arms 68. The paddles 70 extend substantially in parallel with the rotary shaft 60 and have substantially the same length. The distance is substantially the same between the paddles 70 and the rotary shaft 60. The paddles 70 have a semicircular shape in transverse section. It is desired that the rotary shaft 60, flange 64, arms 68 and paddles 70 of the stirrer 58 are molded as a unitary structure using a suitable synthetic resin. Thus, the resilient deformation is relatively easily made in the assembling operation in which one end of the rotary shaft 60 is inserted in the blind hole 30 and the other end thereof is inserted in the through hole 34, contributing to facilitating the assembling operation.

In the stirrer 58, the paddles 70 are provided with plate pieces 90. The plate pieces are made of a suitable synthetic resin film such as polyethylene terephthalate film. The plate pieces 90 extend, from the base portions where they are fitted to the flat surfaces of the paddles 70 by a suitable method such as bonding, in a direction to separate away from the rotary shaft 60 in parallel with the flat surfaces of the paddles 70. The main portions of the plate pieces 90, i.e., the portions extending from the base portions where they are fitted to the paddles 70, have a width (in the axial direction of the rotary shaft 60) which is substantially equal to the length of the paddles 70. Here, the plate pieces 90 have, at the ends thereof, a pair of protruding portions protruding toward both sides thereof. The length of the protruding portions is slightly larger than the thickness of the arms 68 which support the paddles 70. Each of the plate pieces 90 has two holes 100 of substantially the same rectangular shape. The holes 100 are formed in the main portions of the plate pieces 90 at a distance in the direction of width thereof (in the axial direction of the rotary shaft 60).

When the stirrer 58 rotates in the counterclockwise direction in FIG. 3, the flat surfaces of the paddles 70 act upon the toner 38 contained in the container 2 to stir the toner 38, so that the toner 38 existing above the portion 10 of the bottom wall is conveyed to the upper portion of the arcuate portion 8, i.e., conveyed to the portion where the conveyer device 42 is disposed. That is, the paddles 70 have a semicircular shape in transverse section, and the flat surfaces act upon the toner 38, enabling the stirring function and the conveying function to be further enhanced compared with those of the paddles having a circular shape in transverse section. The plate pieces 90 of the paddles 70 sweep the inner surface of the portion 10 of the bottom wall of the container 2 and the inner surface of the rear wall (wall located at the left end in FIG. 3) in order to prevent the toner 38 from staying on the inner surfaces. The loci drawn by the protruding portions formed at the ends of the neighboring plate pieces 90 overlap one upon the other. Accordingly, the plate pieces 90 act upon the inner surface of the container 2 continuously in the axial direction of the rotary shaft 60.

Two holes 100 are formed in each of the plate pieces 90. When the plate pieces 90 rotate as described above, therefore, the toner 38 passes through the holes 100 making it possible to considerably decrease a maximum required rotational torque compared with that of the conventional stirrer. Moreover, the holes 100 of the plate pieces 90 permit the toner 38 to pass through and hence, work to loosen the masses of toner 38. Thus, the plate pieces 90 exhibit enhanced stirring ability.

Novel features of the present invention do not reside in the constitution itself of the stirrer 58 that includes the rotary shaft 60, arms 68, paddles 70 and plate pieces 90 each having two holes 100. The constitution of the stirrer 58 has been described in detail in the specification and drawings of Japanese patent application No. 174549/1996, filed on Jul. 4, 1996 (entitled STIRRER AND TONER CARTRIDGE EQUIPPED WITH THE STIRRER), and is not described in the specification and drawings of the present application.

The toner cartridge constituted according to a second embodiment of the present invention will now be described with reference to FIGS. 5 to 8.

Figure 5:
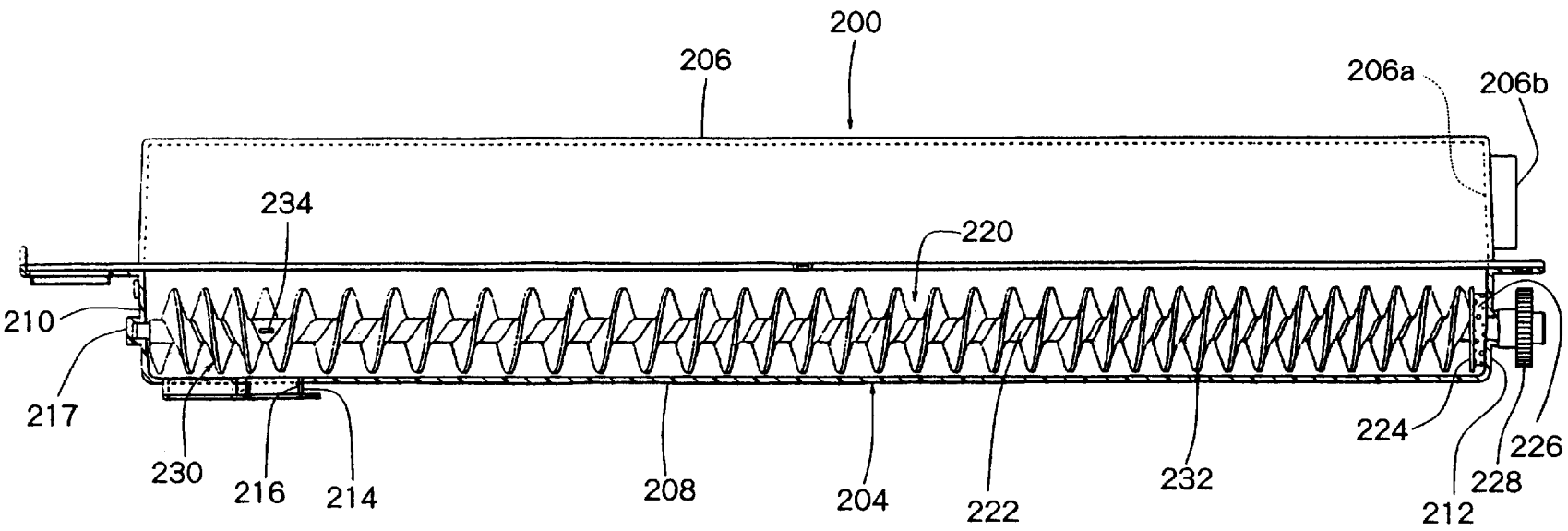
FIG. 5 is a front view illustrating the toner cartridge constituted according to another preferred embodiment of the present invention, but omitting the tone in the container.
Figure 6:
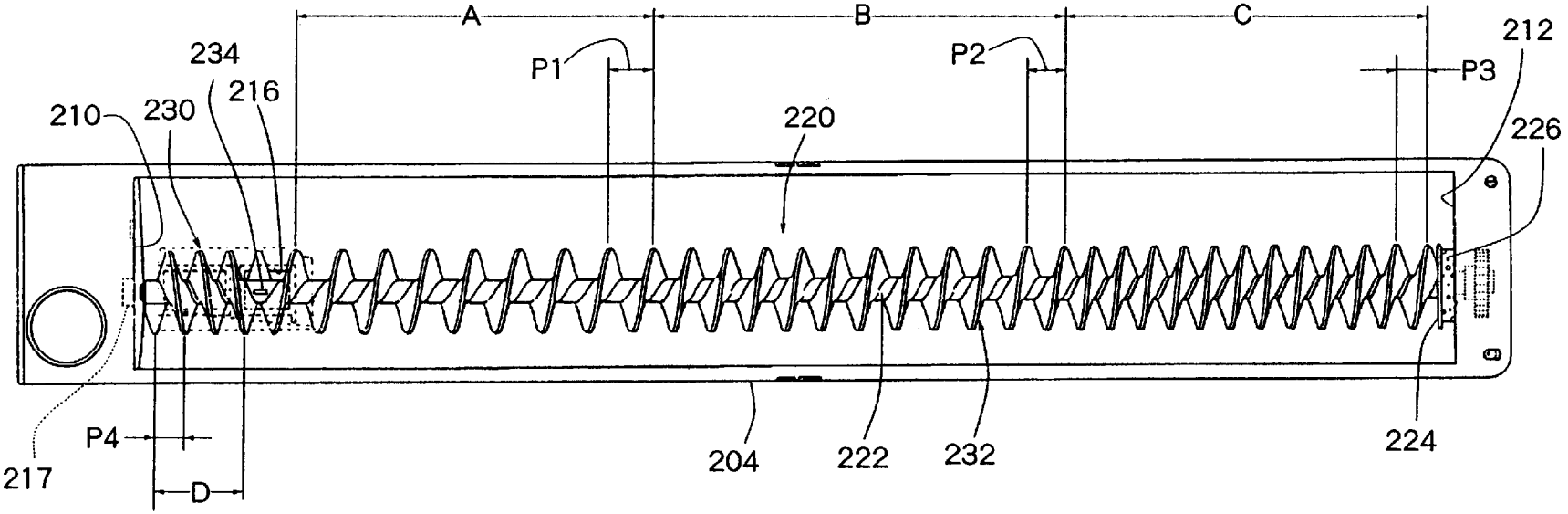
FIG. 6 is a plan view illustrating the toner cartridge shown in FIG. 5, but omitting the upper member of the container and the toner in the container.
Figure 7:
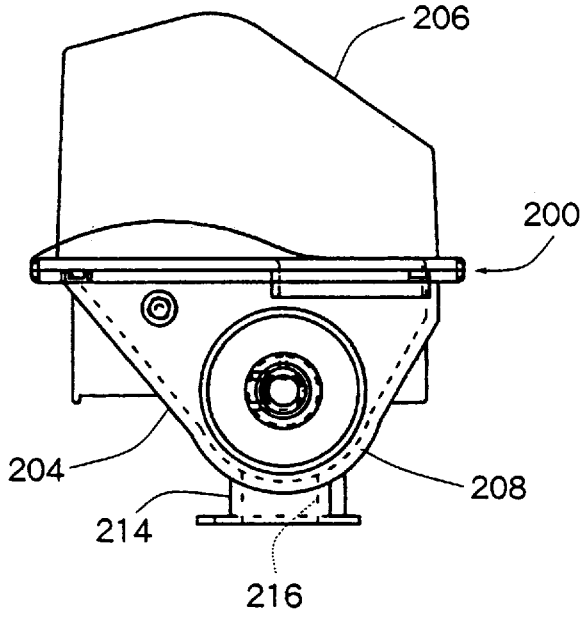
FIG. 7 is side view of when

With reference to FIGS. 5 to 7, the toner cartridge that is illustrated is equipped with a container which is generally designated at 200. The container 200 is constituted by a lower member 204 and an upper member 206. The lower member 204 that can be made of a suitable synthetic resin has the shape of a box with its upper surface opened. As will be clearly comprehended with reference to FIG. 7, the bottom wall of the lower member 204 is defined by a relatively small arcuate portion in the transverse sectional view. The upper member 206 which can similarly be made of a suitable synthetic resin has the shape of a box with its lower surface opened. The upper member 206 is secured to the lower member 204 by a suitable securing means in a manner that the lower surface of the upper member 206 is intimately adhered to the upper surface of the lower member 204. A circular opening **206*b* is formed in one side wall 206*a* of the upper member 206. The container 200 is filled with a required amount of the toner through the circular opening 206*b*. After the container 200 is filled with the toner, a closing member that is not shown is secured to the circular opening 206*b* so that the circular opening 206*b*** is completely closed.

The lower member 204 of the container 200 has a bottom wall 208, and both side walls 210 and 212. A downwardly protruded mouth portion 214 of a nearly rectangular shape is formed in an arcuate portion in the bottom wall 208, and a discharge port 216 is formed in the mouth portion 214. The discharge port 216 has a nearly rectangular shape. Referring to FIG. 7, the discharge port 216 has an upper end that is opened in the upper surface of the arcuate portion of the bottom wall 208 and has a lower end that is opened in the horizontal lower surface of the mouth portion 214. As clearly shown in FIGS. 5 and 6, the discharge port 216 is formed at a position closer to the one side wall 210 between the two side walls 210 and 212. The mouth portion 214 is equipped with a shutter member that is not shown but that slides between a close position to close the discharge port 216 and an open position to open the discharge port 216. The shutter member may be constituted in a known form and hence, its details are not described in this specification. The one side wall 210 has a protruded portion 217. Inside the protruded portion 217 is formed a blind hole that is not clearly shown. The other side wall 212 has a through hole that is not clearly shown to correspond to the blind hole. The blind hole and the through hole are positioned on the center line of curvature of the arcuate portion in the bottom wall 208.

In the lower member 204 of the container 200 is disposed a toner conveyer device 220 at a position above the arcuate portion of the bottom wall 208. The conveyer device 220 includes a toner conveyance mechanism which has a rotary shaft 222. A circular flange 224 is formed near one end of the rotary shaft 222, and an annular sealing member 226 is fitted to the rotary shaft 222 on the outer side of the circular flange 224. The sealing member 226 may be made of a soft sponge. The rotary shaft 222 is inserted, at its other end, in the blind hole formed in the side wall 210, and is resiliently deformed to some extent as a whole, so that the one end thereof is inserted in the through hole formed in the side wall 212. The rotary shaft 222 is, thus, rotatably mounted across the side walls 210 and 212. In the thus mounted state, the rotary shaft 222 is positioned to pass above the discharge port 216.

When the one end of the rotary shaft 222 is inserted in the through hole that is not shown, the circular flange 224 is positioned close to the inner surface of the side wall 212, and the sealing member 226 is compressed to some extent between the circular flange 224 and the side wall 212. The sealing member 226 prevents the toner from leaking out of the container through the hole.

The one end of the rotary shaft 222 protrudes outwardly penetrating through the side wall 212, and an input gear 228 is fitted to the protruded end. When the toner cartridge is mounted on a required position of a developing device (not shown), the input gear 228 is coupled to an electric motor (not shown) via a transmission gear train (not shown). When the electric motor is energized, the rotary shaft 222 is rotated in a predetermined direction.

As will be comprehended with reference to FIGS. 5 and 6, the conveyance mechanism further has a pair of spiral vanes 230 and 232 formed on the rotary shaft 222. The spiral vane 230 has a spiral direction opposite to a spiral direction of the spiral vane 232. The spiral vane 230 extends from the side wall 210 up to an upper portion of the discharge port 216, and the spiral vane 232 extends from the side wall 212 up to an upper portion of the discharge port 216. The rotary shaft 222 is provided with a discharge vane 234 above the discharge port 216. The discharge vane 234 comprises a plate piece which protrudes in the radial direction from the rotary shaft 222. As described above, the position of the discharge port 216 is closer to the side wall 210 between the side walls 210 and 212 and hence, the overall length of the spiral vane 232 is greater than the overall length of the spiral vane 230.

The spiral vanes 230 and 232 have substantially the same outer diameter. Here, it is important that in the spiral vane 232 having the larger overall length, a pitch in a plurality of ranges in the axial direction is formed so as to stepwisely decrease as it separates away from the discharge port 216. As clearly shown in FIG. 6, the spiral vane 232 has three ranges A, B and C of dissimilar pitches in the axial direction. The range A, range B and range C are located in this order in the direction to separate away from the discharge port 216. When the pitch of the range A is denoted by P1, the pitch of the range B by P2 and the pitch of the range C by P3, the pitches are so formed as to establish a relationship $P1>P2>P3$.

The spiral vane 230 having the smaller overall length has a constant pitch P4 substantially over the whole range D thereof. It is desired that the pitch P4 of the spiral vane 230 having the smaller overall length is not larger than the minimum pitch P3 of the spiral vane 232 having the larger overall length (i.e., $P4 \leqq P3$). In this embodiment, the pitches are so defined that $P4=P3$. The amount of the toner present on the side of the spiral vane 230 in the container 200 is very much smaller than the amount of the toner present on the side of the spiral vane 232. Therefore, the pitch P4 of the spiral vane 230 having the smaller overall length is decreased to reduce the amount of conveyance to the discharge port 216 so as to maintain balance with respect to the amount of conveyance by the spiral vane 232. Thus, the toner in the container 200 is uniformly discharged as a whole.

When the rotary shaft 222 is rotated via the input gear 228, the spiral vane 230 conveys the toner rightwards toward the discharge port 216 in FIGS. 5 and 6, and the spiral vane 232 conveys the toner leftwards toward the discharge port 216 in FIGS. 5 and 6. The toner conveyed onto the discharge port 216 falls down from the container 200 through the discharge port and is, thus, supplied from the toner cartridge onto the developing device (not shown).

Figure 8:
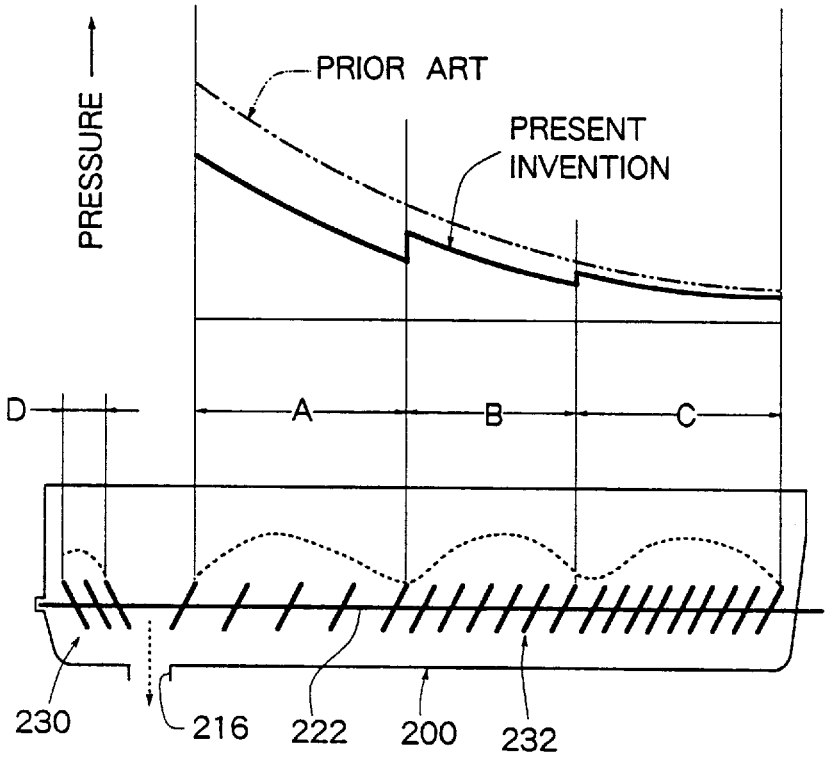
FIG. 8 is a diagram schematically illustrating the characteristics procured by the present invention.

Referring to FIG. 8 together with FIGS. 5 and 6, when the toner is conveyed toward the discharge port 216 by the spiral vane 232 that is rotating in the toner cartridge, the pressure of the toner being conveyed stepwisely increases as it approaches the discharge port 216 in each of the ranges A, B and C of dissimilar pitches of the spiral vane 232 as represented by a solid line in FIG. 8. That is, in each of the ranges A, B and C of dissimilar pitches, the pressure has a tendency to increase from an end remotest from the discharge port 216 toward the discharge port 216. Here, however, the pitch changes to a direction of increasing (e.g. the direction of from P3 to P2) at a boundary between a range (e.g., range C) remote from the discharge port 216 and another neighboring range (e.g., range B) closer to the discharge port 216. As shown by the solid line in FIG. 8, therefore, the pressure once suddenly drops at the boundary where the pitch changes. Therefore, the pressure of the toner that is conveyed does not increase continuously and proportionally (two-dot chain line in FIG. 8) as it proceeds from the end remotest from the discharge port 216 toward the discharge port 216, but increases stepwisely in a manner of increase, decrease, increase, decrease.

Since the pressure for conveying the toner necessarily decreases at a boundary where the pitch changes, the pressure of the toner above the discharge port 216 which is the toner outlet of the spiral vane 232 can be decreased compared to that of the prior art without causing the amount of the toner conveyed by the spiral vane 232 to decrease. Accordingly, the amount of conveying the toner is relatively uniformalized irrespective of the amount of the toner contained in the container 200, and the amount of the toner that is conveyed is brought into proper match with the amount of the toner falling through the discharge port 216. In other words, the toner falls substantially in amounts by which it was conveyed. As a result, the toner staying at the upper part of the discharge port 216 falls in an early time; i.e., the toner present above the discharge port 216 in the container 200 is discharged first, reliably preventing the occurrence of clogging by the toner at the upper portion of the discharge port 216.

In the above-mentioned toner cartridge, furthermore, the velocity for conveying the toner by the spiral vane 232 is not constant over the full length of the spiral vane 232 but stepwisely increases as it approaches the discharge port 216 over the ranges A, B and C in which the spiral vane 232 has dissimilar pitches. That is, the pitch increases (from P3 to P2) at a boundary between a range (e.g., range C) remote from the discharge port and a neighboring range (e.g., range B) closer to the discharge port 216. Therefore, the velocity for conveying the toner increases at the boundary where the pitch changes.

That is, a difference in the velocity for conveying the toner is produced at the boundary between a range remote from the discharge port 216 and a neighboring range closer to the discharge port 216. At the boundary, therefore, a difference is made in the amount of conveyance (the amount of conveyance by the spiral vane 232 is larger in a range closer to the discharge port 216 than the amount of conveyance by the spiral vane remote from the discharge port). As a result, the toner present above the boundary falls on the spiral vane before the toner is conveyed by the spiral vane 232 from the downstream side (right side in FIGS. 5 and 6) and hence, the toner in the container 200 is uniformly discharged as a whole. A dotted line in FIG. 8 represents the toner remaining in the container 200, from which it will be obvious that the toner decreases at a boundary where the pitch changes compared to other portions, and uniformly decreases as a whole in the container 200. This makes it possible to reliably prevent such an inconvenience that the toner in the container 200 is partly coagulated (tunneling phenomenon). Accordingly, the toner does not remain in the container 200 but is all discharged without waste.

EMBODIMENT

In an embodiment in which the conveyer device of the present invention is applied to the toner cartridge, the main sizes of the spiral vanes 230 and 232 were defined as described below. That is, P1=12 mm, length of the range A=96 mm (12 mm×8), P2=10 mm, length of the range B=110 mm (10 mm×11), P3=8 mm, length of the range C=96 mm (8 mm×12), P4=8 mm, length of the range D=24 mm (8 mm×3), diameter of the rotary shaft 222=6 mm, outer diameter of the spiral vanes 230 and 232=22 mm, overall length of the rotary shaft 222 of a portion where the spiral vanes 230 and 232 are formed, measured from the right end surface of the circular flange 224,=about 346 mm.

Though the toner cartridge constituted according to a preferred embodiment of the present invention was described above with reference to the accompanying drawings, it should be noted that the invention is in no way limited to the above embodiment only but can be changed or modified in a variety of other ways without departing from the scope of the invention. For example, in the foregoing was described the embodiment where the conveyer device of the present invention was applied to the toner cartridge, but, the conveyer of the present invention can also be applied to a device of any other form, such as to a developer equipped with a toner conveyance mechanism and to a device equipped with a conveyance mechanism for conveying powder other than toner or developing agent. The conveyer device of the present invention can be further applied to a toner cartridge having a discharge port 216 formed at the end portion on the side of the side wall 210. In this case, on the rotary shaft 222 is formed a spiral vane having the same spiral direction but having pitches that are different in a manner as described above. The conveyer device of the present invention can be applied to a device of any type in which the problems mentioned earlier may take place, irrespective of the position of the discharge port 216.

What we claim is:

1. A conveyer device comprising a container containing a powder therein and having a bottom wall and both side walls, a powder discharge port formed in said bottom wall, and a conveyance mechanism for conveying the powder contained in said container toward said discharge port, said conveyance mechanism including a rotary shaft that is rotatably supported across said both side walls and is positioned to pass above said discharge port and a pair of spiral vanes formed on said rotary shaft and having spiral directions opposite to each other, and said discharge port having a first side edge and a second side edge, said first side edge and second side edge being opposed to each other at a distance in an axial direction of said rotary shaft, wherein one of said spiral vanes extends from said first side edge toward said second side edge of said discharge port above said discharge port, and the other one of said spiral vanes extends from said second side edge toward said first side edge.

2. A conveyer device according to claim 1, wherein said one and said other spiral vanes extend up to one-third said distance between said first side edge and said second side edge.

3. A conveyer device according to claim 1, wherein said spiral vanes have substantially the same outer diameter D and pitch P, and said discharge port is provided with one end edge and another end edge opposed to each other at a distance W in a direction at right angles with said axial direction, and when said distance between said first side edge and said second side edge is denoted by L, the following relations are satisfied, W=0.95 D to 1.05 D L=0.95 P to 1.05 P.

4. A toner cartridge including a conveyer device which comprises a container containing a toner therein and having a bottom wall and both side walls, a toner discharge port formed in said bottom wall, and a conveyance mechanism for conveying the toner contained in said container toward said toner discharge port, said conveyance mechanism including a rotary shaft that is rotatably supported across said both side walls and is positioned to pass above said toner discharge port and a pair of spiral vanes formed on said rotary shaft and having spiral directions opposite to each other, and said toner discharge port having a first side edge and a second side edge, said first side edge and said second side edge being opposed to each other at a distance in an axial direction of said rotary shaft, wherein one of said spiral vanes extends from said first side edge toward said second side edge of said discharge port above said toner discharge port, and the other one of said spiral vanes extends from said second side edge toward said first side edge.

5. A toner cartridge according to claim 4, wherein said one and said other spiral vanes extend up to one-third said distance between said first side edge and said second side edge.

6. A toner cartridge according to claim 4, wherein said spiral vanes have substantially the same outer diameter D and pitch P, and said discharge port is provided with one end edge and another end edge opposed to each other at a distance W in a direction at right angles with said axial direction, and when said distance-between said first side edge and said second edge is denoted by L, the following relations are satisfied, W=0.95 D to 1.05 D L=0.95 P to 1.05 P.

7. A conveyer device comprising a container containing a powder therein and having a bottom wall and both side walls, a powder discharge port formed in said bottom wall, and a conveyance mechanism for conveying the powder contained in said container toward said discharge port, said conveyance mechanism including a rotary shaft that is rotatably supported across said both side walls and is positioned to pass above said discharge port and spiral vane structure formed on said rotary shaft, wherein said spiral vane structure includes a spiral vane which is so formed that a pitch thereof stepwisely decreases in a plurality of ranges in an axial direction as it separates away from said discharge port in the axial direction.

8. A conveyer device according to claim 7, wherein said discharge port is formed at a position closer to either one of the two side walls, and said spiral vane structure comprises a pair of spiral vanes having spiral directions that are opposite to each other at a portion of said discharge port as a boundary, one of said two spiral vanes having an overall length larger than an overall length of the other spiral vane, and said one spiral vane having a pitch which stepwisely decreases in a plurality of ranges in the axial direction as it separates away from said discharge port in the axial direction.

9. A conveyer device according to claim 8, wherein said other spiral vane has a pitch which is not larger than a minimum pitch of said one spiral vane.

10. A toner cartridge including a conveyer device which comprises a container containing a toner therein and having a bottom wall and both side walls, a toner discharge port formed in said bottom wall, and a conveyance mechanism for conveying the toner contained in said container toward said toner discharge port, said conveyance mechanism including a rotary shaft that is rotatably supported across said both side walls and is positioned to pass above said toner discharge port and spiral vane structure formed on said rotary shaft, wherein said spiral vane structure is so formed that a pitch thereof stepwisely decreases in a plurality of ranges in an axial direction as it separates away from said discharge port in the axial direction.

11. A toner cartridge according to claim 10, wherein said discharge port is formed at a position closer to either one of the two side walls, and said spiral vane structure comprises a pair of spiral vanes having spiral directions that are opposite to each other at a portion of said discharge port as a boundary, one of said two spiral vanes having an overall length larger than an overall length of the other spiral vane, and said one spiral vane having a pitch which stepwisely decreases in a plurality of ranges in the axial direction as it separates away from said discharge port in the axial direction.

12. A toner cartridge according to claim 11, wherein said other spiral vane has a pitch which is not larger than a minimum pitch of said one spiral vane.

* * * * *